US007311541B2

(12) United States Patent
Chien et al.

(10) Patent No.: US 7,311,541 B2
(45) Date of Patent: Dec. 25, 2007

(54) ELECTRONIC CONNECTOR

(75) Inventors: Chih-Wei Chien, Shenzhen (CN); Chang-Hsuan Chen, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/308,893

(22) Filed: May 23, 2006

(65) Prior Publication Data

US 2007/0082537 A1 Apr. 12, 2007

(30) Foreign Application Priority Data

Oct. 12, 2005 (CN) ..... 2005 1 0100388

(51) Int. Cl.
*H01R 13/64* (2006.01)

(52) U.S. Cl. ..... 439/246; 439/341

(58) Field of Classification Search ..... 439/246, 439/248, 341, 607

See application file for complete search history.

(56) References Cited

U.S. PATENT DOCUMENTS 4,940,417 A * 7/1990 Hyogo et al. ..... 439/248
4,954,085 A * 9/1990 Inoue et al. ..... 439/34
5,402,316 A 3/1995 Volz et al.
5,857,863 A * 1/1999 Onizuka et al. ..... 439/248
6,290,523 B1 * 9/2001 Barnhart et al. ..... 439/248
6,833,989 B2 12/2004 Helot et al.
2005/0026499 A1 2/2005 Choi
2007/0082537 A1 * 4/2007 Chien et al. ..... 439/377

* cited by examiner

*Primary Examiner*—James R. Harvey
(74) *Attorney, Agent, or Firm*—Winston Hsu

(57) ABSTRACT

An electronic connector includes a cover, a connector body and an aligning plate. The cover defines an opening therein. The connector body protrudes through the opening, and defines a first interspace therebetween for the connector body to be partially and movably received in the opening. The aligning plate includes a supporting portion securing with and supporting the connector body, and at least two setting portions arranged at two opposite ends of the supporting portion. The aligning plate slidably mounts the connector body to the cover, the slidable directions are substantially parallel to an imaginary plane defined by the two setting portions.

20 Claims, 6 Drawing Sheets

ELECTRONIC CONNECTOR

FIELD OF THE INVENTION

The present invention relates to an electronic connector and, more particularly, to an electronic connector with an aligning structure.

DESCRIPTION OF RELATED ART

Portable computers, such as notebook computers and personal digital assistants (PDAs), are popular and commonly used devices that provide users with mobile computing power in small, lightweight, portable packages. Portable computers usually have less functionality with smaller devices than that of a desktop computer. For example, the portable computer may lack certain data drive modules (e.g. a CD-ROM drive or a floppy drive) and may have a smaller monitor and keyboard peripherals.

A docking station has been developed to enhance and extend functions found in a desktop computer usable by portable computer. The docking station typically provides a connector to connect to a complementary connector of the portable computer, thereby establishing a digital connection between the portable computer and the docking station.

Referring to FIG. 6, a general assembly of a portable computer 20 and a docking station 40 is illustrated. The portable computer 20 includes a bottom plate 22 and a complementary connector 24 fixed on the bottom plate 22. The docking station 40 includes an upper plate 42 and a primary connector 44 secured on the upper plate 42. The portable computer 20 and the docking station 40 may be electrically connected via the engagement of the complementary connector 24 and the primary connector 44.

However, misalignment may occur when the complementary connector 24 is engaged with the primary connector 44. If misalignment occurs therebetween, it makes the engagement incorrect and difficult.

Therefore, an electronic connector with an aligning structure is desired.

SUMMARY OF INVENTION

An electronic connector includes a cover, a connector body and an aligning plate. The cover defines an opening therein. The connector body protrudes through the opening, and defines a first interspace therebetween for the connector body to be partially and movably received in the opening. The aligning plate includes a supporting portion securing to and supporting the connector body, and at least two setting portions arranged at two opposite ends of the supporting portion. The aligning plate slidably mounts the connector body to the cover, slidable directions are substantially parallel to an imaginary plane defined by the two setting portions.

Other advantages and novel features will become more apparent from the following detailed description of preferred embodiments when taken in conjunction with the accompanying drawings, in which:

DETAILED DESCRIPTION

In the following embodiments, a docking station for a portable computer is used as an example for illustration. It is noted that electronic apparatuses in these embodiments may be portable computers, or any other electronic apparatuses.

Figure 1:
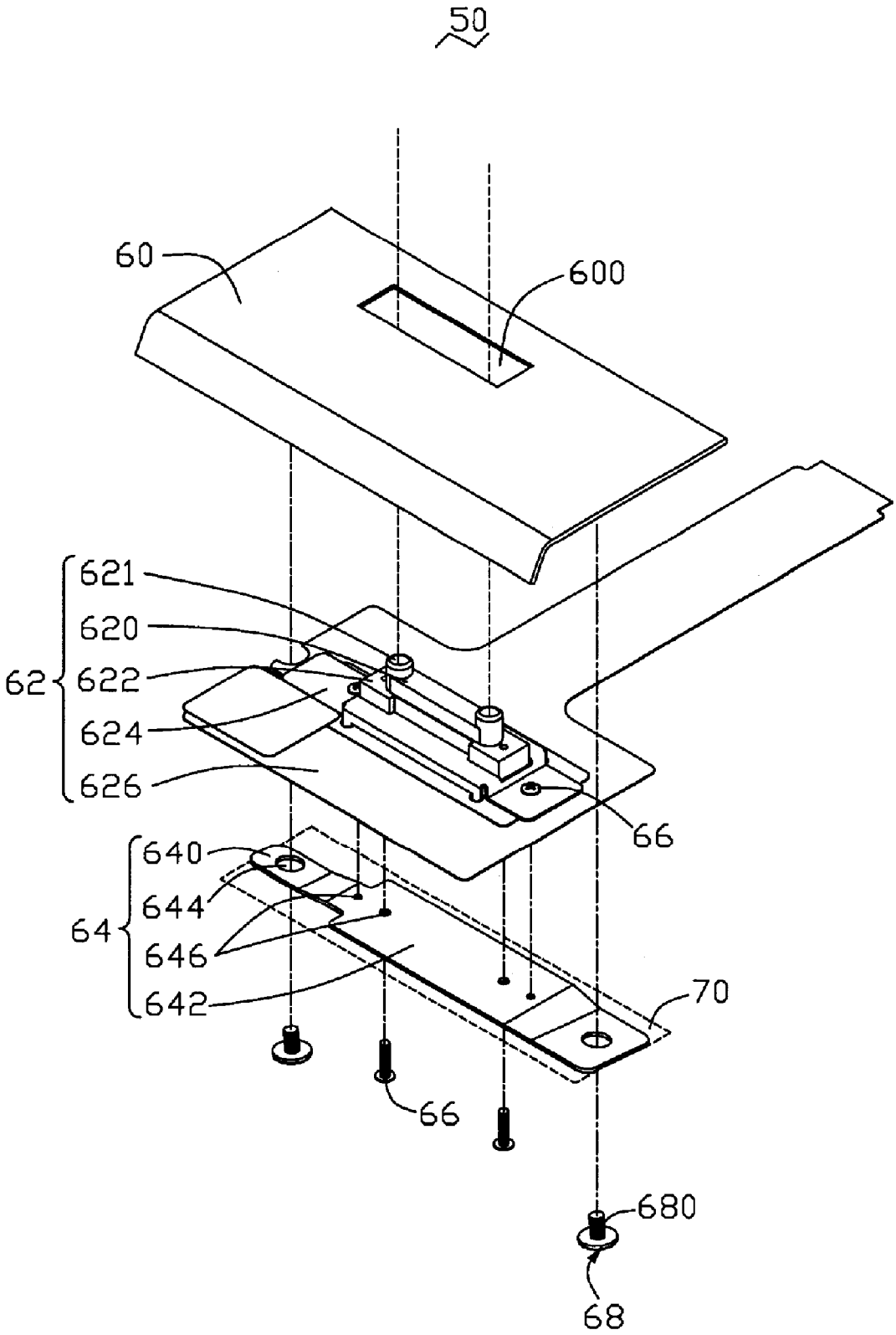
FIG. 1 is an exploded, isometric view of an electronic connector for electronic apparatus in accordance with an exemplary embodiment.
Figure 2:
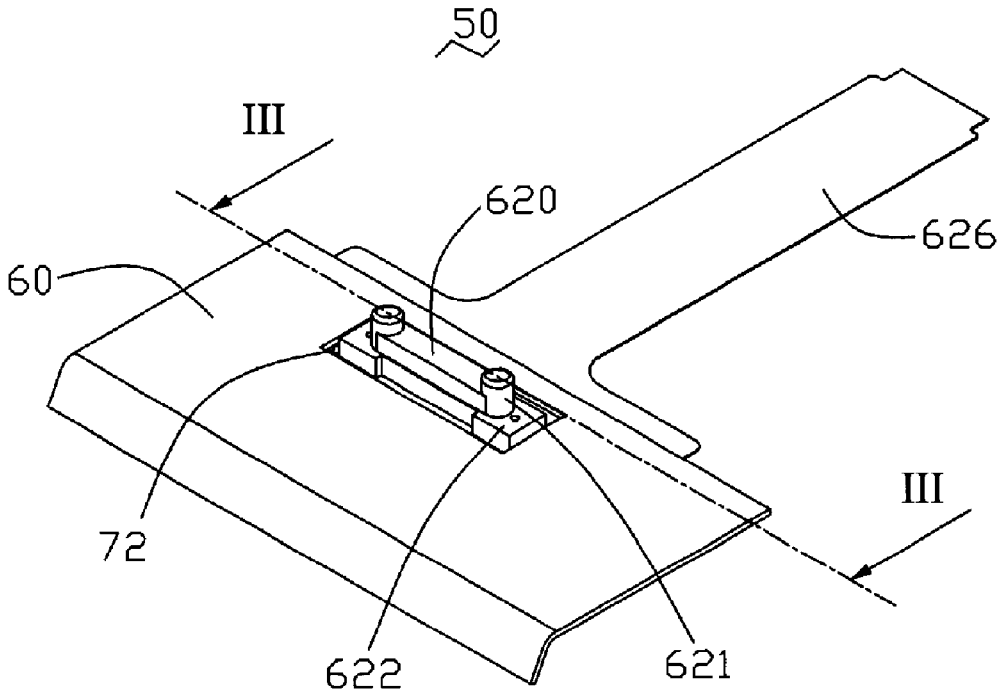
FIG. 2 is an isometric view of the electronic connector of FIG. 1.
Figure 3:
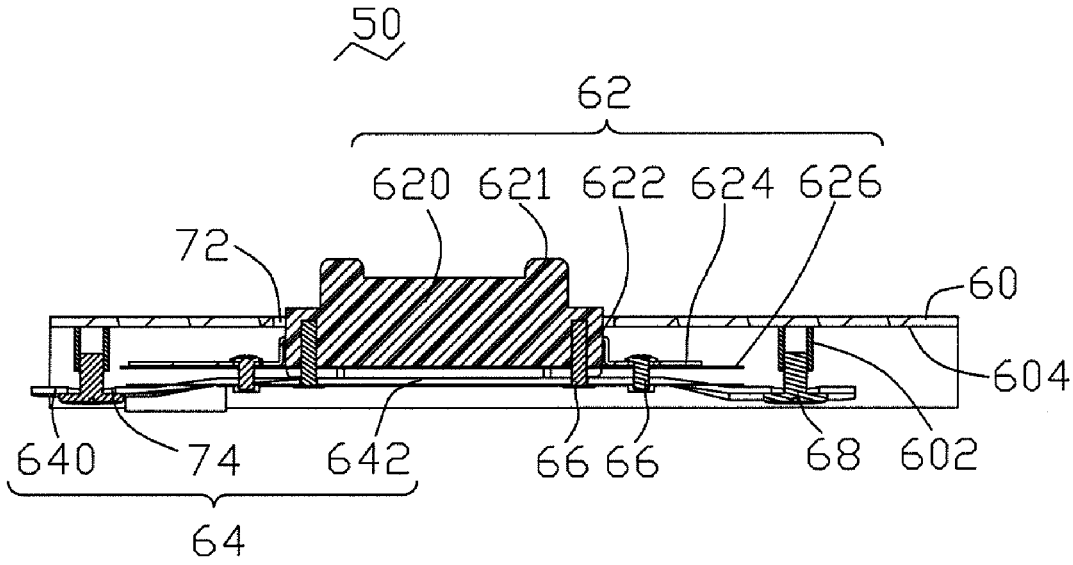
FIG. 3 is a cross-sectional view of the electronic connector of FIG. 2, taken along line III-III thereof.

Referring to FIGS. 1 to 3, an electronic connector 50 according to the embodiment is illustrated. The electronic connector 50 includes a cover 60, a connector body 62 and an aligning plate 64. The cover 60, the connector body 62 and the aligning plate 64 are assembled in that order.

The cover 60 defines an opening 600 therein to allow the connector body 62 to partially extend therethrough. A pair of positioning posts 602 extend downward from a bottom surface 604 of the cover 60, with the opening 600 therebetween.

The connector body 62 includes a mating portion 620, a pair of guiding pins 621, a base portion 622, an intermediate plate 624, and a flexible PCB (printed circuit board) 626. The base portion 622 is mounted on top of the intermediate plate 624. The mating portion 620 extends a predetermined distance away from the base portion 622. The pair of guiding pins 621 are arranged at two opposite ends of the mating portion 620.

The aligning plate 64 includes a pair of setting portions 640 and a supporting portion 642. The supporting portion 642 is integrally formed with the setting portions 640. The setting portions 640 are parallel to each other and arranged at two opposite ends of the supporting portion 642. The two setting portions 640 define an imaginary plane 70. The supporting portion 642 rises relative to the imaginary plane 70 for high strength performance. A through hole 644 is defined in each setting portions 640 and a pair of fixing holes 646 are defined in the supporting portion 642. The opening 600 is wider than the base portion 622 so as to define a first interspace 72 therebetween. The size of the first interspace 72 is large enough for the base portion 622 to move predetermined distances in directions substantially parallel to the imaginary plane 70.

The cover 60, the connector body 62 and the aligning plate 64 may be assembled as described in the following; The connector body 62 is secured to the supporting portion 642 of the aligning plate 64, with a plurality of fixing screws 66 screwed through the corresponding fixing holes 646. The guiding pin 621, the mating portion 620 and the base portion 622 respectively protrude through the opening 600. A pair of screws 68 pass through the pair of corresponding through holes 644, and then are screwed into the pair of corresponding positioning posts 602. The base portion 622 may be moved to predetermined distances in directions substantially parallel to the imaginary plane 70.

Referring to FIG. 3 again, each screw 68 includes a threaded shaft 680 partially screwed into the corresponding positioning post 602. A diameter of each through hole 644 may be much larger than that of the threaded shaft 68 to define a second interspace 74 therebetween. The size of the second interspace 74 substantially equals to that of the first interspace 72 and is large enough for the aligning plate 64 to move predetermined distances in directions substantially parallel to the imaginary plane 70.

Figure 4:
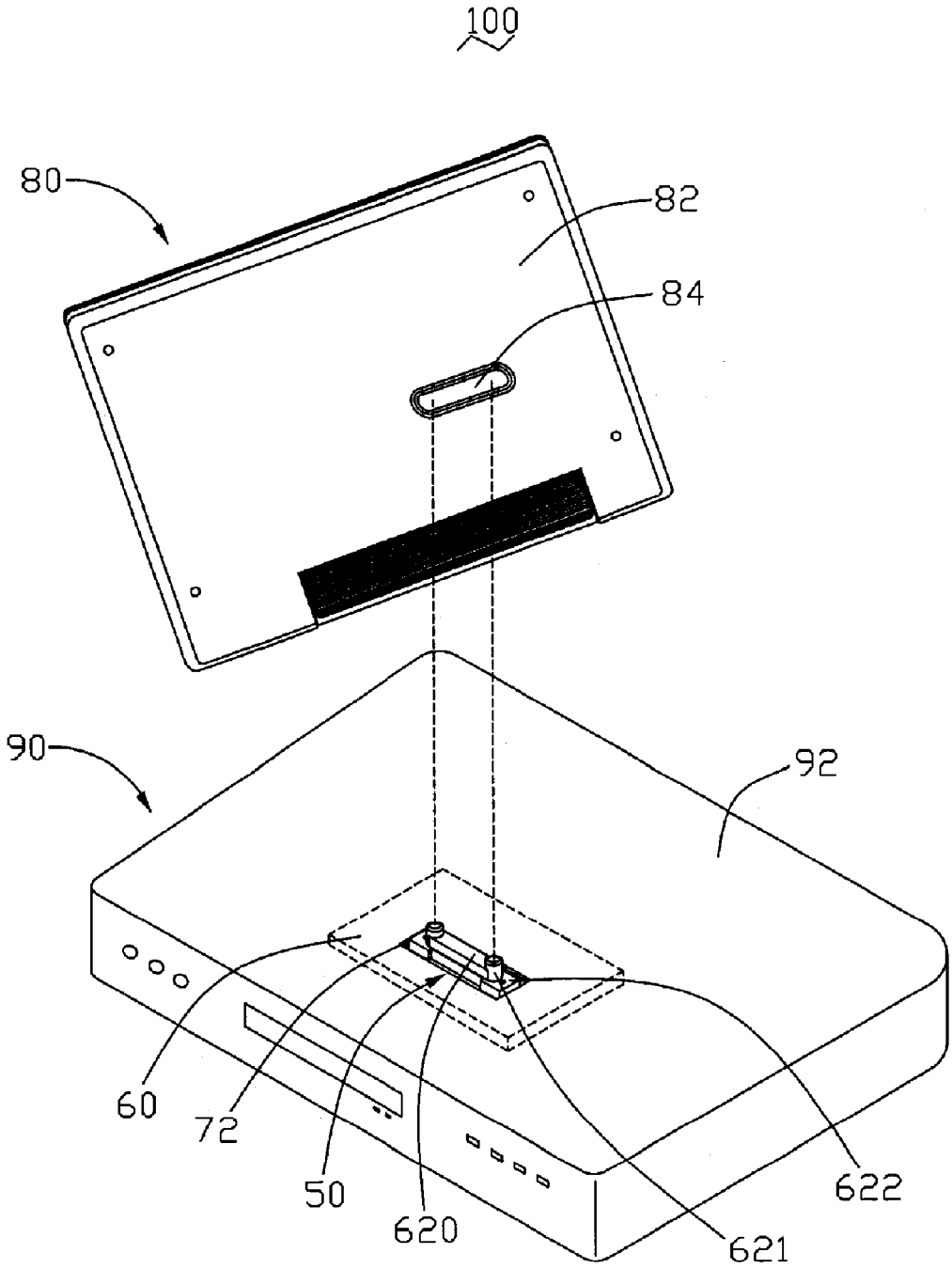
FIG. 4 is an isometric view of a portable computer and a docking station employing the electronic connector of FIG. 2.

Referring also to FIG. 4, an assembly of a portable computer 80 and a docking station 90 is illustrated. The portable computer 80 includes a bottom plate 82 and a complementary connector 84 fixed on the bottom plate 82. The docking station 90 includes an upper plate 92 and the previously described electronic connector 50 secured on top of the upper plate 92. The cover 60 may be integrally formed with the upper plate 92. The portable computer 80 and the docking station 90 may be electronically interconnected via the engagement of the connector 84 and the electronic connector 50.

When the portable computer 80 is incorporated to the docking station 90 so as to assemble a system 100, the complementary connector 84 is supposed to align with the electronic connector 50. However, in general, the complementary connector 84 is seldom precisely aligned to the electronic connector 50 on the first attempt because the mating mechanism, such as the electronic connector 50 or complementary connector 84, is hidden from one's view by the portable computer 80. However, once the complementary connector 84 is in contact with the electronic connector 50, a pressure will be applied on the guiding pins 621 or the mating portion 620. The pressure can push the connector body 62 to move in a direction that parallels the imaginary plane 70 within an allowable range permitted by the above-described interspaces (72 and 74, or 72 and 76) until the electronic connector 50 can precisely align with the complementary connector 84. Making the engagement between the electronic connector 50 and the complementary connector 84 quite easy.

The supporting portion 642 may be parallel to or inclined towards the imaginary plane 70. The supporting portion 642 may be on the same imaginary plane 70 with the setting portions 640 if only the aligning plate 64 is strong enough to support the connector body 62 when the connector body 62 is pressed by the complementary connector 84. In addition, the supporting portion 642 may not be integrally formed with the setting portions 640.

Figure 5:
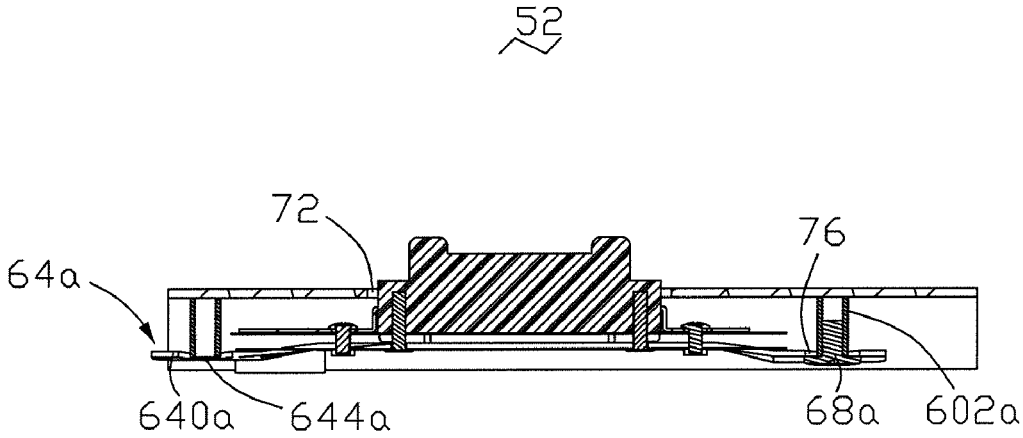
FIG. 5 is a cross-sectional view of an electronic connector in accordance with a second exemplary embodiment, with a screw being removed.
Figure 6:
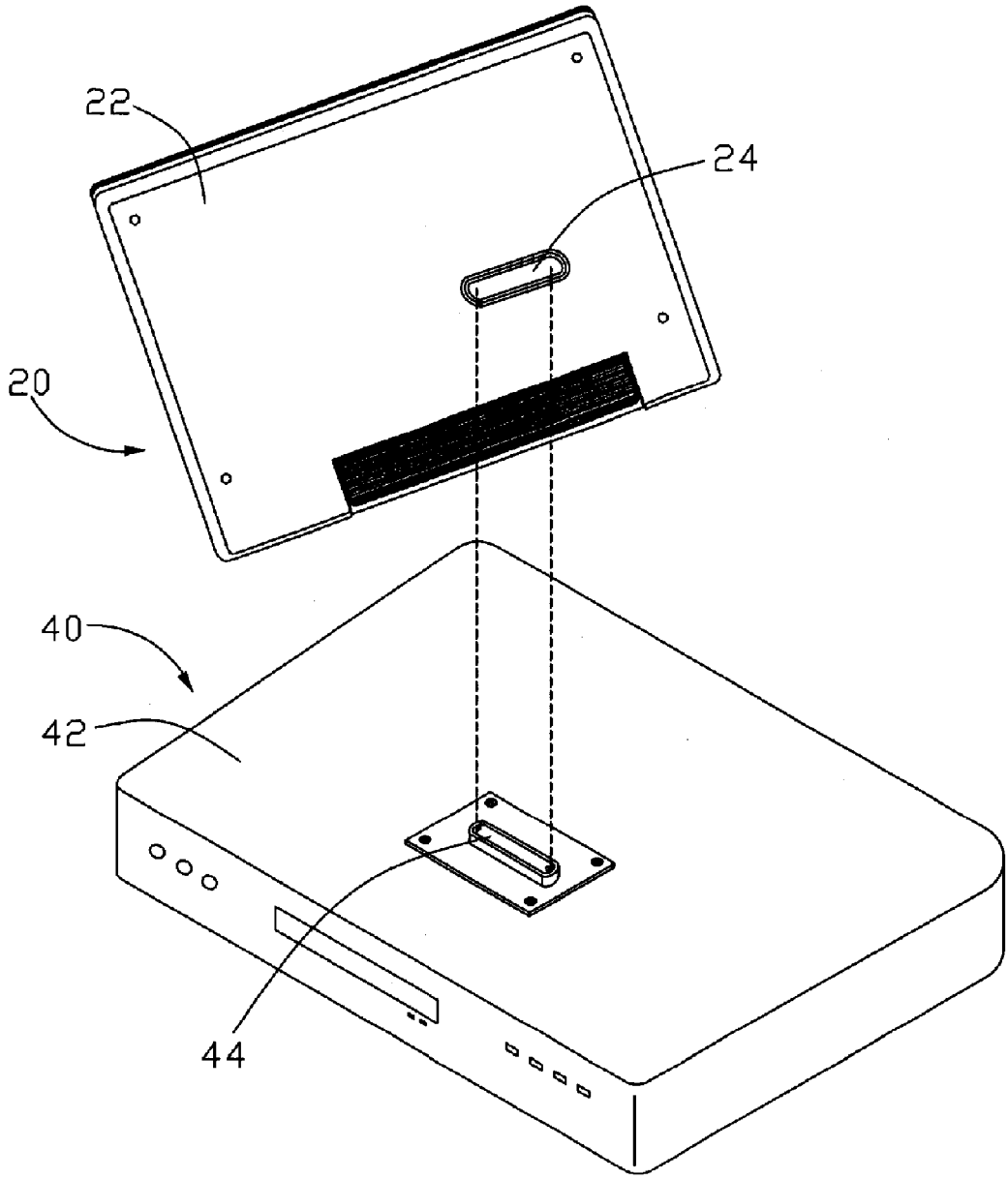
FIG. 6(Related Art)
FIG. 6 is an isometric view of a general portable computer and a docking station each having a general electronic connector.

Referring also to FIG. 5, another electronic connector 52 in accordance with a second exemplary embodiment is illustrated. A threaded shaft (not labeled) of each screw 68*a* is substantially entirely screwed into a corresponding positioning post 602*a*. A diameter of each through hole 644*a* is much larger than that of each positioning post 602*a* to define a third interspace 76 therebetween. The size of third interspace 76 substantially equals to the first interspace 72 and is large enough for an aligning plate 64*a* to move in a direction that substantially parallels an imaginary plane (not shown) defined by a pair of setting portions 640*a*.

The embodiments described herein are merely illustrative of the principles of the present invention. Other arrangements and advantages may be devised by those skilled in the art without departing from the spirit and scope of the present invention. Accordingly, the present invention should be deemed not to be limited to the above detailed description, but rather by the spirit and scope of the claims that follow, and their equivalents.

What is claimed is:

1. An electronic connector comprising:

a cover defining an opening therein;

a connector body protruding through the opening and defining a first interspace between the cover and the connector body for the connector body to be partially and movably received in the opening; and an aligning plate comprising a supporting portion secured to and supporting the connector body, and at least two setting portions arranged at two opposite ends of the supporting portion, the aligning plate mounting the connector body to the cover and movable along movable directions that are substantially parallel to an imaginary plane defined by the two setting portions.

2. The electronic connector as claimed in claim 1, wherein the supporting portion rises relative to the imaginary plane.

3. The electronic connector as claimed in claim 1, wherein the supporting portion inclines towards the imaginary plane.

4. The electronic connector as claimed in claim 1, wherein the supporting portion is integrally formed with the setting portions.

5. The electronic connector as claimed in claim 1, wherein each setting portion defines a through hole therein for a screw inserting therethrough.

6. The electronic connector as claimed in claim 5, wherein each through hole and a corresponding screw define a second interspace between the setting portion and the corresponding screw, the size of the second interspace substantially equaling the size of the first interspace.

7. The electronic connector as claimed in claim 5, wherein the cover comprises a pair of positioning posts respectively corresponding to the pair of through holes, the pair of positioning posts projecting downward from a bottom surface of the cover for the pair of screws being screwed thereinto.

8. The electronic connector as claimed in claim 7, wherein each through hole and the corresponding positioning post define a third interspace between the setting portion and the positioning post, the size of the third interspace substantially equaling to the size of the first interspace.

9. An electronic apparatus comprising:

an electronic connector comprising:

a cover defining an opening therein;

a connector body protruding through the opening and defining a first interspace between the cover and the connector body for the connector body to be partially and movably received in the opening; and an aligning plate comprising a supporting portion secured with and supporting the connector body, and at least two parallel setting portions arranged at two opposite ends of the supporting portion, the aligning plate mounting the connector body to the cover and movable along movable directions that are substantially parallel to an imaginary plane defined by the two setting portions; and a housing for receiving the electronic connector.

10. The electronic apparatus as claimed in claim 9, wherein the supporting portion protrudes towards the connector body relative to the imaginary plane.

11. The electronic apparatus as claimed in claim 9, wherein the supporting portion slants relative to the imaginary plane.

12. The electronic apparatus as claimed in claim 9, wherein the supporting portion is integrally formed with the setting portions.

13. The electronic apparatus as claimed in claim 9, wherein the cover is formed integrally with the housing.

14. The electronic apparatus as claimed in claim 9, wherein each setting portion defines a through hole therein for a screw inserting therethrough.

15. The electronic apparatus as claimed in claim 14, wherein each through hole and the corresponding screw define a second interspace between the setting portion and the corresponding screw, the size of the second interspace substantially equaling that of the first interspace.

16. The electronic apparatus as claimed in claim 14, wherein the cover comprises a pair of positioning posts, the pair of positioning posts extending downward from a bottom surface of the cover for the pair of screws being screwed thereinto.

17. The electronic apparatus as claimed in claim 14, wherein each through hole and the corresponding positioning post define a third interspace between the setting portion and the positioning post, the size of the third interspace substantially equaling to that of the first interspace.

18. A docking station comprising:

a cover defining an opening therein, the cover comprising a pair of positioning posts protruding downward from a bottom surface thereof;

a connector body protruding through the opening, the connector body defining a first interspace between the cover and the connector body for the connector body to be movably received in the opening;

an aligning plate comprising a supporting portion secured to and supporting the connector body, and two parallel setting portions arranged at two opposite ends of the supporting portion, each setting portion defining a through hole corresponding to each positioning post;

a pair of screws respectively passing through the corresponding through holes before being screwed into the positioning posts, and a second interspace being defined between each through hole and corresponding screw, so that the aligning plate mounts the connector body to the cover and so that the connector body and the aligning plate are movable relative to the cover.

19. The electronic apparatus as claimed in claim 18, wherein the supporting portion protrudes towards the connector body relative to the setting portions.

20. The electronic apparatus as claimed in claim 18, wherein the supporting portion is integrally formed with the setting portions.

* * * * *